US005240385A

United States Patent [19]

Nashiro et al.

[11] Patent Number: 5,240,385

[45] Date of Patent: Aug. 31, 1993

[54] VARIABLE DISPLACEMENT WOBBLE PLATE TYPE COMPRESSOR

[75] Inventors: Toshio Nashiro; Toyokazu Aida; Hiroyasu Nadamoto, all of Tokyo, Japan

[73] Assignee: Calsonic Corporation, Tokyo, Japan

[21] Appl. No.: 917,638

[22] Filed: Jul. 23, 1992

[30] Foreign Application Priority Data

Jul. 23, 1991 [JP] Japan ..... 3-57013[U]

[51] Int. Cl.[5] ..... F04B 27/08

[52] U.S. Cl. ..... 417/222.2

[58] Field of Search ..... 417/222.2

[56] References Cited

U.S. PATENT DOCUMENTS 4,702,677 10/1987 Takenaka et al. ..... 417/222.2

4,752,189 6/1988 Bearint et al. ..... 417/222.2

FOREIGN PATENT DOCUMENTS 286591 12/1986 Japan .

282182 12/1987 Japan ..... 417/222.2

2233047 1/1991 United Kingdom ..... 417/222.2

*Primary Examiner*—Richard E. Gluck

*Attorney, Agent, or Firm*—Foley & Lardner

[57] ABSTRACT

In a variable displacement wobble plate type compressor, first, second and third connecting passages are defined. The first connecting passage fluidly connects a bellows chamber in which a bellows is installed with a suction chamber to which refrigerant from an evaporator is returned. The second connecting passage fluidly connects a discharge chamber and a crank chamber through a valve port. The discharge chamber is a chamber from which compressed refrigerant is discharged and the crank chamber is a chamber in which a wobble plate is operatively disposed. The bellows installed in the bellows chamber changes its volume in accordance with a pressure in the bellows chamber. A control valve controls the valve port in response to the volume change of the bellows. The third connecting passage is a passage which fluidly connects the suction passage and the crank chamber without using the bellows chamber as a part thereof.

8 Claims, 2 Drawing Sheets

VARIABLE DISPLACEMENT WOBBLE PLATE TYPE COMPRESSOR

BACKGROUND OF THE INVENTION

1. Field of the Invention

The present invention relates to variable displacement wobble plate type compressors for use in an automotive air conditioning system or the like and more particularly to such compressors of a type whose controllability under high speed operation is improved.

2. Description of the Prior Art

In order to clarify the task of the present invention, one conventional compressor of the above-mentioned type will be described with reference to FIG. 2, which is disclosed in Japanese Utility Model First Provisional Publications Nos. 64-56,577 and 1-160,179.

The compressor 3 shown in FIG. 2 is of a type in which the volume of compression chambers defined by a cylinder block 25 is varied in accordance with a suction pressure of a refrigerant returned to the compressor 3 thereby to control the refrigerant discharge from the compressor 3. With this, the inlet pressure of the compressor 3 is kept constant during its operation.

When, in an air conditioning system, the inlet pressure of the compressor is kept constant, the pressure of refrigerant at an outlet port of the evaporator is kept constant, so that undesired freezing of the evaporator under low load can be avoided. Furthermore, the compressor discharges refrigerant in accordance with thermal load applied to the evaporator, so that the number of ON-OFF switching of a magnet clutch can be correspondingly reduced. The reduction of such switching reduces or lightens undesired change in temperature of air blown into a passenger room as well as change in torque of the engine.

As shown in FIG. 2, the compressor 3 comprises a drive shaft 11 which is driven by an engine (not shown) through a belt (not shown), a pulley 2 and a magnet clutch 2*a*. A drive rod 11*a* is connected to the drive shaft 11 in a manner to extend normally thereto, so that the drive rod 11*a* is turned in a crank chamber 12 together with the drive shaft 11. A drive plate 13 is pivotally connected to the drive rod 11*a* through a pin 11*b* and arranged so that its angle of inclination with respect to the drive shaft 11 is variable. Thus, the torque of the drive shaft 11 is transmitted to the drive plate 13 through the drive rod 11*a* and the pin 11*b*.

A nonrotatable wobble plate 16 is slidably mounted on the drive plate 13 by way of a thrust bearing 14 and a radial bearing 15. The wobble plate 16 is provieed with a shoe 19 which is slidably connected to a guide pin 18 fixed to the casing 17 of the crank chamber 12. This arrangement prevents the wobble plate 16 from rotating within the crank chamber 12 while allowing the inclination thereof to be varied.

A plurality of equally spaced piston rods 22 are connected to the wobble plate 16. Pistons 23 are connected to the other ends of the piston rods 22.

When the drive plate 13 is rotated, the wobble plate 16 is moved in a manner to induce each of the pistons 23 to undergo reciprocative movement in the cylinders or bores 26 formed in the cylinder block 25. Thus, during the reciprocative movement of the pistons 23, each working chamber defined before the piston 23 is subjected to alternate volume change effecting pumping action. As shown, the chamber defined behind each piston 23 is communicated with the crank chamber 12.

A cylinder head 30 is formed with a suction chamber 29 and a discharge chamber 13. The suction chamber 29 is arranged to communicate with a conduit through which refrigerant is returned from an evaporator (not shown). Inlet valves 34 are operatively mounted on a valve plate 20, so that they control inlet ports 27 formed in the valve plate 20. Discharge valves (no numerals) are also mounted on the valve plate 20 to control outlet ports 28 which communicate the cylinders 26 (more specifically, working chambers) and the discharge chamber 33. The valve plate 20 is sandwiched between the cylinder head 30 and the cylinder block 25, and formed of three layers. The center layer is suitably recessed or apertured to form a communication passage structure therein as well become apparent hereinafter.

The refrigerant led into the suction chamber 29 is also supplied through a connecting passage 32*a* to an intake pressure chamber 32 formed in the cylinder head 30, and then the refrigerant is supplied to a bellows chamber 64 through a first connecting passage R1.

The refrigerant compressed in the cylinders 26 is discharged into the discharge chamber 33 through the controllable outlet ports 28 and then discharged through a pipe (not shown) to a condenser (not shown). Part of the refrigerant in the discharge chamber 33 is supplied to a discharge pressure chamber 35 formed in a valve chamber V.

The valve chamber V is formed in the cylinder head 30 between the intake and discharge pressure chambers 32 and 35. Within the valve chamber V, there is installed a valve case h for a control valve Cv. The control valve Cv is arranged to operate in accordance with the pressure of the refrigerant returned to the suction chamber 29. That is, when the pressure of the returning refrigerant is relatively low, the control valve Cv closes a first valve port 40 and opens a second valve port 47, and while when the pressure of the returning refrigerant is relatively high, the control valve Cv opens the first valve port 40 and closes the second valve port 47. The control valve Cv has at a lower portion thereof a first valve element 36 and at an upper portion thereof a second valve element 39. The first valve element 36 controls the first valve port 40 with an aid of a bellows 37 which expands and contracts in a manner to establish an equilibrium between the pressure prevailing in the intake pressure chamber 32 and a spring 38 disposed in the bellows 37.

The first valve element 36 is formed with an operation rod 46 whose leading end is formed with the second valve element 39, so that movements of the first and second valve elements 36 and 39 are synchronously carried out. The first and second valve elements 36 and 39 are so arranged that as the first valve element 36 is moved toward a closed position, the second valve element 39 is moved toward an open one and vice versa.

With this arrangement, when the thermal load on the evaporator is low, the refrigerant which is returned to the compressor 3 has not absorbed much heat and thus produces a relatively low pressure in the suction chamber 29. Under this condition, the pressure (which will be referred to as "intake pressure Ps" hereinafter) in the intake pressure chamber 32 is low, and thus the bellows 37 expands and moves the first and second valve elements 36 and 39 upward as seen in the drawing. With this movement, the second valve port 47 is largely opened and part of the refrigerant (which will be referred to as "discharge pressure Pd") which is compressed by the piston 23 under compression stroke and discharged through the corresponding control outlet port 28 is supplied to the crank chamber 12 through the second valve port 47 and a second connecting passage R2 which includes a passage 62, a passage 63, a passage 48, a center opening 44 and a center passage 45. Thus, under such condition, the pressure (which will be referred to as "crank chamber pressure Pc" hereinafter) in the crank chamber 12 is increased.

The angle of inclination of the wobble plate 16 is controlled by the pressure prevailing in the crank chamber 12, more specifically, by pressures applied to the pistons 23 in forward and rearward directions. When the pressure Pc in the crank chamber 12 increases and exceeds that prevailing in the suction chamber 29, the pressure differential acting across the pistons 23 induces a moment of force which rotates the wobble plate 16 and the drive plate 13 about the pin 11*b* in a direction to reduce the angle of inclination.

Under this condition, the stroke of the pistons 23 is reduced and the amount of refrigerant discharged by the compressor 3 is correspondingly reduced. That is, the amount of the refrigerant circulated in the cooling system becomes suitable to the lower thermal load on the evaporator. With reduction of the refrigerant, the intake pressure Ps of the compressor 3 is gradually increased and an essentially constant pressure Ps is resultingly maintained.

The compressed refrigerant supplied to the crank chamber 12 contains a trace of lubricant oil which is applied through the center passage 45 of the drive shaft 11 and its drain port 45*b* to the radial bearing 15 which is arranged between the drive plate 13 and a sliding surface 15*a* of the wobble plate 16.

When the thermal load on the evaporator is high, the intake pressure Ps increases. This induces the bellows 37 to contract and move the first and second valve elements 36 and 39 downward as seen in the drawing. With this movement, the first valve port 40 is opened and the second valve port 47 is closed. Accordingly, the highly compressed discharge pressure Pd is not supplied to the crank chamber 12. However, when the intake pressure Ps is smaller than the pressure Pc in the crank chamber 12, the refrigerant in the crank chamber 12 is supplied to the suction chamber 29 through a third connecting passage R3 which includes a cylinder passage 61, a passage 41, the first valve port 40 and the bellows chamber 64. With this, the crank chamber pressure Pc becomes equal to the intake pressure Ps.

Thus, due to the work of the above-mentioned moment of force, the wobble plate 16 and the drive plate 13 are maximally inclined relative to the drive shaft 11 thereby increasing the stroke of the pistons 23. Thus, the amount of refrigerant discharged by the compressor 3 is correspondingly increased and thus becomes suitable to the higher thermal load on the evaporator. With increase of the refrigerant, the intake pressure Ps of the compressor 3 is gradually reduced and an essentially constant pressure Ps is resultingly maintained.

However, the above-described conventional compressor 3 has encountered drawbacks due to its inherent arrangement in which the surrounding of the bellows 37 serves as not only a pressure sensing means but also a refrigerant flowing means. That is, when, like in the case of the higher thermal load on the evaporator, the refrigerant from the crank chamber 12 is forced to flow through the third connecting passage R3, the dynamic pressure of the refrigerant is applied to the bellows 37. Under this condition, there is produced a pressure differential between the real intake pressure Ps and the pressure Ps' actually sensed by the bellows 37. In fact, the relationship of "Ps' > Ps" is established. Thus, due to the work of the moment of force applied to the wobble plate 16 and the drive plate 13, the angle of inclination of them relative to the drive shaft 11 is subjected to an undesirable change by a degree corresponding to the pressure differential. In fact, in such case, the angle of inclination of the wobble plate 16 and the drive plate 13 is further increased and thus the stroke of the pistons 23 is further increased resulting in that the intake pressure Ps of the compressor 3 is further reduced.

When the compressor 3 runs at high speed, it is necessary to increase the pressure Pc in the crank chamber 12 and reduce the stroke of the pistons 23. However, in this case, the amount of the refrigerant flowing around the bellows 37 is correspondingly increased and the above-mentioned pressure differential is further increased. Thus, the controllability of the compressor 3 is lowered.

SUMMARY OF THE INVENTION

It is therefore an object of the present invention to provide a variable displacement wobble plate type compressor which is free of the above-mentioned drawbacks.

According to a first aspect of the present invention, there is provided a variable displacement wobble plate type compressor which comprises a casing having suction and discharge chambers formed therein, the casing further having a crank chamber formed therein; means for defining a bellows chamber; pumping means for compressing fluid fed thereto from the suction chamber and discharging the compressed fluid to the discharge chamber; a wobble plate inclinably disposed in the crank chamber to control the capacity of the pumping means in accordance with a pressure in the crank chamber; means for defining a first connecting passage which fluidly connects the bellows chamber with the suction chamber; a bellows installed in the bellows chamber and changing its volume in accordance with the pressure prevailing in the bellows chamber; a control valve for controlling a valve port in accordance with the volume change of the bellows; means for defining a second connecting passage which fluidly connects the discharge chamber and the crank chamber through the valve port; and means for defining a third connecting passage which fluidly connects the suction chamber with the crank chamber, wherein the third connecting passage is a passage isolated from the bellows chamber.

According to a second aspect of the present invention, there is provided an improved arrangement in a variable displacement wobble plate type compressor. The compressor includes a casing having suction and discharge chambers, a bellows chamber and a crank chamber formed therein; pumping means for compressing fluid fed thereto from the suction chamber and discharging the compressed fluid to the discharge chamber; a wobble plate inclinably disposed in the crank chamber to control the capacity of the pumping means in accordance with a pressure in the crank chamber; means for defining a first connecting passage which fluidly connects the bellows chamber with the suction chamber; a bellows installed in the bellows chamber and changing its volume in accordance with the pressure prevailing in the bellows chamber; a control valve for controlling a valve port in accordance with the volume chamber of the bellows; means for defining a second connecting passage which fluidly connects the discharge chamber and the crank chamber through the valve port; and means for defining a third connecting passage which fluidly connects the suction chamber with the crank chamber. The improved arrangement is an arrangement wherein the third connecting passage connects the suction chamber with the crank chamber without using the bellows chamber as a part thereof.

According to a third aspect of the present invention, there is provided a variable displacement wobble plate type compressor which comprises a casing having a suction chamber, a discharge chamber, a crank chamber and a valve chamber; a valve casing detachably disposed in the valve chamber having having a bellows chamber defined therein; pumping means installed in the casing for compressing fluid fed thereto from the suction chamber and discharging the compressed fluid to the discharge chamber; a wobble plate inclinably disposed in the crank chamber to control the pumping capacity of the pumping means in accordance with a pressure prevailing in the crank chamber; means for defining a first connecting passage which fluidly connects the bellows chamber with the suction chamber; a bellows installed in the bellows chamber and changing its volume in accordance with the pressure prevailing in the bellows chamber; a control valve for controlling a valve port in accordance with the volume change of the bellows; means for defining a second connecting passage which fluidly connects the discharge chamber and the crank chamber through the valve port; and means for defining a third connecting passage which connects the suction chamber with the crank chamber without using the bellows chamber as a part thereof.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
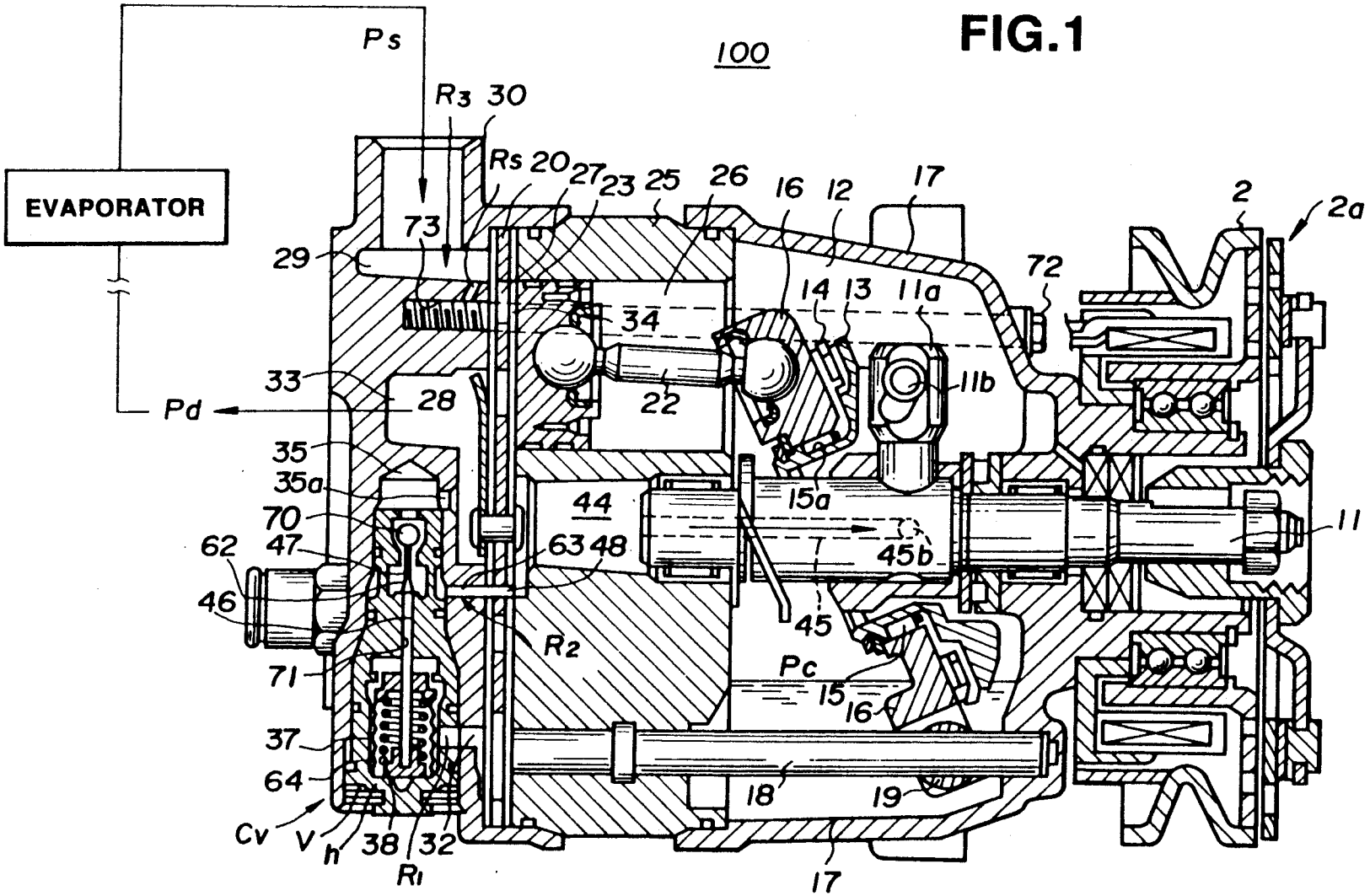
FIG. 1 is a sectional view of a variable displacement wobble plate type compressor according to the present invention.
Figure 2:
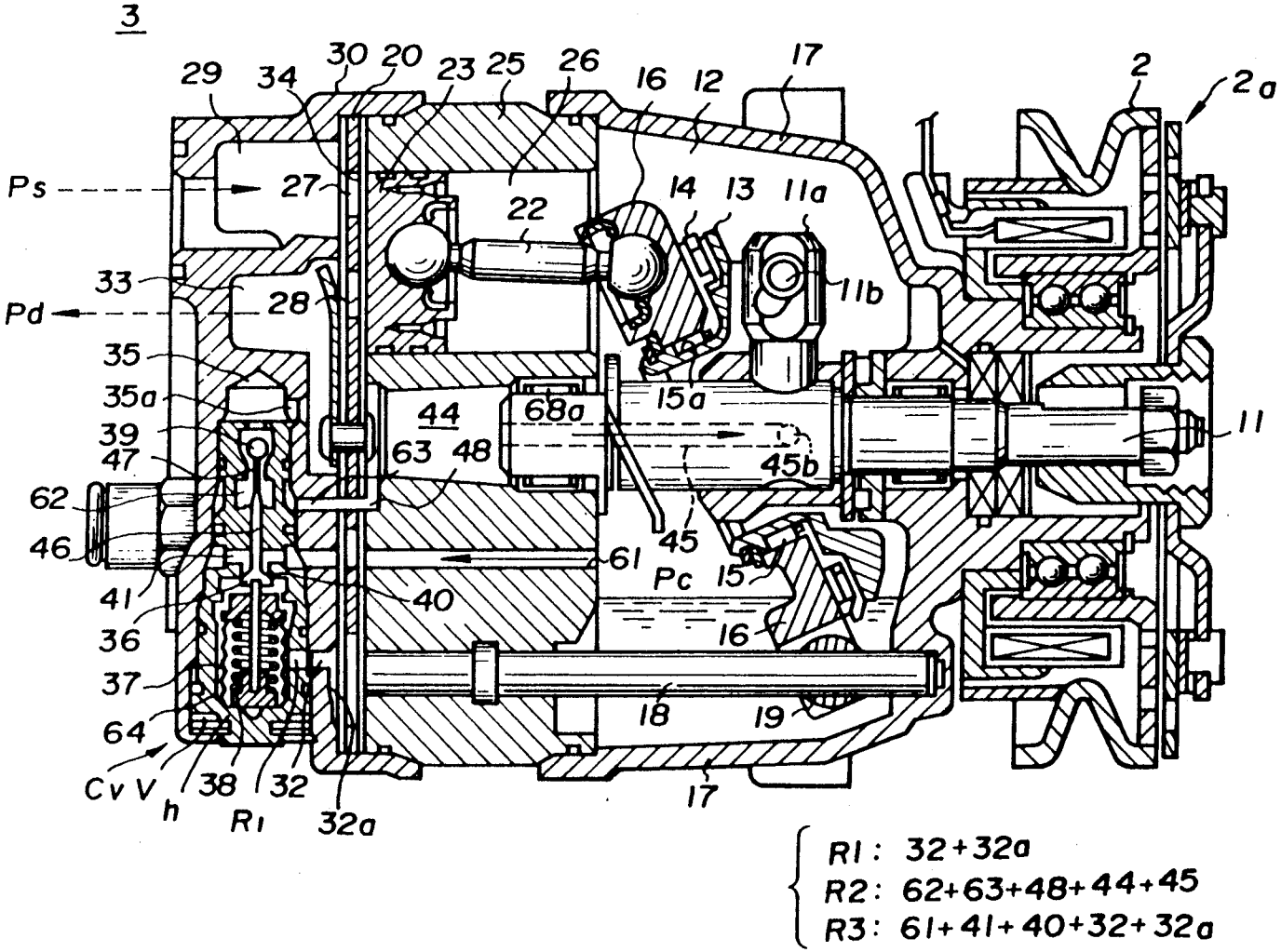
FIG.2 (PRIOR ART)
FIG. 2 is a sectional view of a conventional compressor of the same type.

Referring to FIG. 1, there is shown a variable displacement wobble plate type compressor 100 according the present invention.

As shown, the compressor 100 of the invention is similar in construction to the above-described conventional one 3. Thus, the substantially same parts and constructions as those of the conventional one are denoted by the same numerals and detailed description of them will be omitted from the following description.

As shown in the drawing, a control valve Cv is installed in a valve chamber V formed in the cylinder head 30. The cylinder head 30 is a part of the casing 17.

The control valve Cv has a valve case h screwed into the valve chamber V. The valve case h has a bellows chamber 64 formed therein. A first connecting passage R1 is formed in a lower side portion of the valve case h, through which the bellows chamber 64 is communicated with an intake pressure chamber 32, that is, with a suction chamber 29. Within the bellows chamber 64, there is installed a bellows 37 which expands and contracts in accordance with the pressure in the intake pressure chamber 32. A spring 38 is installed in the bellows 37.

To an upper portion of the valve case h, there is connected one end of a second connecting passage R2 which is communicated with a discharge pressure chamber 35 into which compressed refrigerant is to be led. The other end of the second discharge passage R2 is communicated with the crank chamber 12. The second connecting passage R2 is equipped at its middle part with a valve port 47 which is controlled by a valve element 70 fixed to a leading end of an operation rod 46. The operation rod 46 is connected to the bellows 37 to move axially in response the expansion and contraction of the bellows 37. The operation rod 46 is axially movably received in a center passage 71 formed in the valve case h.

In the present invention, the following unique measure is practically employed in providing a third connecting passage R3 which leads the pressure Ps of returned refrigerant to the crank chamber 12.

That is, in the invention, there is no means which corresponds to the cylinder passage 61 employed in the above-mentioned conventional compressor 3, and the third connecting passage R3 is so positioned and arranged as not to flow refrigerant around the bellows 37.

More specifically, the third connecting passage R3 in the present invention comprises a sub-connecting passage Rs which is formed in the cylinder head 30, and a bolt hole 73 which extends from the cylinder head 30 to the crank chamber 12 for operatively receiving a connecting bolt 72. In order to permit the bolt hole 73 to serve as a fluid passage, the connecting bolt 72 is somewhat reduced in diameter with respect to the size of the bolt hole 73.

As will be understood from FIG. 1, the connecting bolt 72 is one of bolts by which the casing 17, the cylinder block 25 and the cylinder head 30 are tightly united. Thus, if desired, all of the bolt holes 73 for the connecting bolts 72 may be used as a part of the third connecting passage R3.

Of course, the third connecting passage R3 may be an independent passage which is formed in the cylinder head 30 and the cylinder block 25 to connect the suction chamber 29 with the crank chamber 12.

In the following, operation of the compressor 100 of the present invention will be described.

When the thermal load on the evaporator is low, the returned refrigerant having a lower intake pressure Ps is led into the bellows chamber 64 through the suction chamber 29, and thus the bellows 37 is forced to expand with an aid of the spring 38 thereby to cause the valve element 70 to open the valve opening 47. Thus, under this condition, part of refrigerant which is highly compressed by the pistons 23 and has a higher discharge pressure Pd is led into the crank chamber 12 through the second connecting passage R2, so that the crank chamber pressure Pc is increased. Accordingly, the stroke of the pistons 23 is reduced and the amount of refrigerant discharged by the compressor 100 is correspondingly reduced. That is, the amount of the refrigerant circulated in the cooling system becomes suitable to the lower thermal load on the evaporator. With reduction of the refrigerant, the intake pressure Ps of the compressor 100 is gradually increased and an essentially constant pressure Ps is resultingly maintained.

When the thermal load on the evaporator is high, the returned refrigerant having a higher intake pressure Ps is led into the bellows chamber 64 through the suction chamber 29, and thus the bellows 37 is forced to contract against the force of the spring 38 thereby to cause the valve element 70 to close the valve opening 47. Thus, under this condition, the refrigerant which is highly compressed by the pistons 23 and has a higher discharge pressure Pd is not led into the crank chamber 12.

Under this condition, the higher intake pressure Ps is led into the crank chamber 12 through the third connecting passage R3 which consists of the sub-connecting passage Rs and the bolt hole 73. That is, there is no flow of refrigerant around the bellows 37, unlike the case of the above-mentioned conventional compressor 3. This means that the bellows 37 is accurately operated in accordance with the real pressure of refrigerant, and there is no pressure differential between the intake pressure Ps and the crank chamber pressure Pc.

Due to moment of force applied to the wobble plate 16 and the drive plate 13, they are largely inclined relative to the drive shaft 11 thereby increasing the stroke of the pistons 23. Thus, the amount of refrigerant discharged by the compressor 100 is correspondingly increased and thus becomes suitable to the higher thermal load on the evaporator. With increase of the refrigerant, the intake pressure Ps of the compressor 100 is gradually reduced and an essentially constant pressure Ps is resultingly maintained.

Even when the compressor 100 runs at high speed wherein increase of the crank chamber pressure Pc and the stroke of the pistons 23 are necessary, there is no flow of refrigerant around the bellows 37. Thus, undesired reduction in intake pressure Ps does not occur even under such high speed running of the compressor 100.

What is claimed is:

1. A variable displacement wobble plate type compressor comprising:

a casing having a suction chamber, a discharge chamber, a crank chamber and a valve chamber;

a valve casing detachably disposed in said valve chamber having a bellows chamber defined therein;

pumping means installed in said casing for compressing fluid fed thereto from said suction chamber and discharging the compressed fluid to said discharge chamber;

a wobble plate inclinably disposed in said crank chamber to control the pumping capacity of said pumping means in accordance with a pressure prevailing in said crank chamber;

means for defining a first connecting passage which fluidly connects said bellows chamber with said suction chamber;

a bellows installed in said bellows chamber and changing its volume in accordance with the pressure prevailing in said bellows chamber;

a control valve for controlling a valve port in accordance with the volume change of said bellows;

means for defining a second connecting passage which fluidly connects said discharge chamber and said crank chamber through said valve port; and means for defining a third connecting passage which is formed in said casing to connect said suction chamber with said crank chamber without using said bellows chamber as a part thereof, said third connecting passage including:

a passage which is formed in said casing, said passage having one end exposed to said suction chamber; and a bolt hole which is formed in said casing to operatively receive a connecting bolt by which said casing is tightly assembled, said bolt hole having one end connected to the other end of said passage and the other end exposed to said crank chamber.

2. A variable displacement wobble plate type compressor comprising:

a casing having suction and discharge chambers formed therein, said casing further having a crank chamber formed therein;

means for defining a bellows chamber;

pumping means for compressing fluid fed thereto from said suction chamber and discharging the compressed fluid to said discharge chamber;

a wobble plate inclinably disposed in said crank chamber to control the capacity of said pumping means in accordance with a pressure in said crank chamber;

means for defining a first connecting passage which fluidly connects said bellows chamber with said suction chamber;

a bellows installed in said bellows chamber and changing its volume in accordance with the pressure prevailing in said bellows chamber;

a control valve for controlling a valve port in accordance with the volume change of said bellows;

means for defining a second connecting passage which fluidly connects said discharge chamber and said crank chamber through said valve port; and means for defining a third connecting passage which is formed in said casing to fluidly connect said suction chamber with said crank chamber, said third connecting passage being a passage isolated from said bellows chamber and including a passage formed in said casing and a bolt hole formed in said casing for operatively receiving a connecting bolt.

3. A variable displacement wobble plate type compressor as claimed in claim 2, in which said means for defining said bellows chamber is a valve case which is detachably disposed in a valve chamber defined in said casing.

4. A variable displacement wobble plate type compressor as claimed in claim 3, in which said valve port is defined in said valve case.

5. A variable displacement wobble plate type compressor as claimed in claim 4, in which said control valve comprises:

an operation rod axially slidably received in a passage formed in said valve case, said operation rod having one end fixed to said bellows; and a valve element fixed to the other end of said operation rod and arranged to selectively open and close said valve port in response to the axial movement of said operation rod.

6. A variable displacement wobble plate type compressor as claimed in claim 5, further comprising a spring which is disposed in said bellows to bias the bellows in a direction to expand the same.

7. A variable displacement wobble plate type compressor as claimed in claim 2, in which said casing comprises:

a casing proper within which said crank chamber is defined;

a cylinder block in which said pumping means is installed; and a cylinder head in which said suction and discharge chambers and said bellows chamber are defined, wherein said casing proper, said cylinder block and said cylinder head are tightly united by said connecting bolt and wherein said third connecting passage is a bolt hole which extends from said cylinder head to the crank chamber in said casing proper.

8. A variable displacement wobble plate type compressor as claimed in claim 7, in which said connecting bolt is reduced in diameter as compared with the size of the corresponding bolt hole.

* * * * *